US010938494B2

(12) United States Patent
Dillon et al.

(10) Patent No.: US 10,938,494 B2
(45) Date of Patent: Mar. 2, 2021

(54) OVER-THE-AIR RADIO BROADCAST SIGNAL METADATA

(71) Applicant: Ibiquity Digital Corporation, Columbia, MD (US)

(72) Inventors: Robert Michael Dillon, Basking Ridge, NJ (US); Paul Venezia, Keene, NH (US)

(73) Assignee: Ibiquily Digital Corporation, Columbia, MD (US)

( * ) Notice: Subject to any disclaimer, the term of this patent is extended or adjusted under 35 U.S.C. 154(b) by 0 days.

(21) Appl. No.: 15/787,397

(22) Filed: Oct. 18, 2017

(65) Prior Publication Data

US 2018/0041296 A1 Feb. 8, 2018

Related U.S. Application Data

(63) Continuation of application No. 15/493,605, filed on Apr. 21, 2017.

(Continued)

(51) Int. Cl.
*H04H 60/37* (2008.01)
*H04H 60/13* (2008.01)

(Continued)

(52) U.S. Cl.
CPC ..... *H04H 60/37* (2013.01); *H04H 20/12* (2013.01); *H04H 60/13* (2013.01); *H04H 60/74* (2013.01);

(Continued)

(58) Field of Classification Search
CPC ..... H04H 60/37; H04H 20/12; H04H 60/13; H04H 20/24; H04H 20/57; H04H 60/82;

(Continued)

(56) References Cited

U.S. PATENT DOCUMENTS 6,845,230 B2 1/2005 Syed
7,721,337 B2 5/2010 Syed (Continued)

FOREIGN PATENT DOCUMENTS

WO WO-2016106307 A1 6/2016
WO WO-2017184963 A1 10/2017

OTHER PUBLICATIONS

"U.S. Appl. No. 14/580,920, Applicant's Summary of Examiner Interview filed Jul. 21, 2016", 1 pg.

(Continued)

*Primary Examiner* — Keith Ferguson
(74) *Attorney, Agent, or Firm* — Schwegman Lundberg & Woessner, P.A.

(57) ABSTRACT

Over-the-air radio broadcast signals are commonly used to deliver a variety of programming content (e.g., audio, etc.) to radio receiver systems. Supplemental data (e.g., metadata) may be provided to radio broadcast receiver systems, where such supplemental data is associated with the programming content delivered via the over-the-air radio broadcast signals. In exemplary embodiments described herein, a radio receiver system receives both (i) primary programming content via over-the-air radio broadcast transmission, and (ii) metadata related to the programming content via wireless Internet. This use of metadata provides a user with an enhanced experience regardless of the type of terrestrial broadcast signal that is received at the user's radio receiver system. Users receiving radio broadcast signals at a receiver system may view images, videos, multimedia displays, text, etc., that is related to the programming content received via the over-the-air radio broadcast signals.

20 Claims, 5 Drawing Sheets

Related U.S. Application Data

(60) Provisional application No. 62/326,432, filed on Apr. 22, 2016.

(51) Int. Cl.
*H04H 20/12* (2008.01)
*H04H 60/74* (2008.01)
*H04H 60/88* (2008.01)

(52) U.S. Cl.
CPC ..... *H04H 60/88* (2013.01); *H04H 2201/18* (2013.01); *H04H 2201/40* (2013.01)

(58) Field of Classification Search
CPC ..... H04H 60/43; H04H 60/44; H04H 60/73; H04H 20/22
USPC ..... 455/3.01–3.06, 445, 403, 422.1, 466, 455/456.1, 414.4; 725/62–72
See application file for complete search history.

(56) References Cited

U.S. PATENT DOCUMENTS

| | | | | |
|---|---|---|---|---|
| 8,111,716 | B2 | 2/2012 | Iannuzzelli et al. | |
| 8,417,179 | B2 | 4/2013 | Watanabe | |
| 8,676,114 | B2 | 3/2014 | Dillon et al. | |
| 9,467,255 | B2 | 10/2016 | Milbar et al. | |
| 2001/0012277 | A1 | 8/2001 | Campanella | |
| 2002/0184339 | A1 | 12/2002 | Mackintosh et al. | |
| 2003/0070172 | A1 | 4/2003 | Matsuzaki et al. | |
| 2003/0083977 | A1 | 5/2003 | Syed | |
| 2003/0084108 | A1 | 5/2003 | Syed | |
| 2003/0135464 | A1 | 7/2003 | Mourad et al. | |
| 2005/0003808 | A1 | 1/2005 | Bates et al. | |
| 2006/0242153 | A1 | 10/2006 | Newberry et al. | |
| 2007/0291876 | A1 | 12/2007 | Shridhar et al. | |
| 2008/0152039 | A1 | 6/2008 | Shah et al. | |
| 2009/0061763 | A1 | 3/2009 | Dillon et al. | |
| 2010/0063931 | A1 | 3/2010 | Cole et al. | |
| 2010/0229205 | A1 | 9/2010 | Hakusui et al. | |
| 2011/0213681 | A1 | 9/2011 | Shahid | |
| 2012/0051543 | A1* | 3/2012 | Evans | H04H 20/106 380/270 |
| 2012/0099514 | A1 | 4/2012 | Bianchetti et al. | |
| 2013/0094426 | A1 | 4/2013 | Devine et al. | |
| 2014/0099879 | A1 | 4/2014 | Birks et al. | |
| 2014/0115627 | A1* | 4/2014 | Lee | H04N 21/812 725/34 |
| 2015/0019465 | A1* | 1/2015 | Littlejohn | H04N 21/44209 706/12 |
| 2016/0182192 | A1 | 6/2016 | Milbar et al. | |
| 2017/0019215 | A1 | 1/2017 | Milbar et al. | |
| 2017/0310411 | A1 | 10/2017 | Dillon et al. | |

OTHER PUBLICATIONS

"U.S. Appl. No. 14/580,920, Notice of Allowance dated Jun. 3, 2016", 12 pgs.
"U.S. Appl. No. 14/580,920, Notice of Allowance dated Jun. 21, 2016", 6 pgs.
"U.S. Appl. No. 14/580,920 Preliminary Amendment filed Dec. 23, 2014", 10 pgs.
"U.S. Appl. No. 15/277,481, Preliminary Amendment filed Sep. 27, 2016", 2 pgs.
"U.S. Appl. No. 15/493,605, Non Final Office Action dated Aug. 21, 2017", 10 pgs.
"International Application Serial No. PCT/US2015/067356, International Preliminary Report on Patentability dated Jul. 6, 2017", 21 pgs.
"International Application Serial No. PCT/US2015/067356, International Search Report dated Mar. 17, 2016", 2 pgs.
"International Application Serial No. PCT/US2015/067356, Written Opinion dated Mar. 17, 2016", 19 pgs.
"International Application Serial No. PCT/US2017/028812, International Search Report dated Jun. 29, 2017", 2 pgs.
"International Application Serial No. PCT/US2017/028812, Written Opinion dated Jun. 29, 2017", 6 pgs.
Baek, Myung-Sun, et al., "Field trials and evaluations of in-band digital radio technologies: HD radio and DRM+", Sep. 2013, IEEE Trans. on broadcasting, vol. 59, No. 3, (Sep. 2013), 401-411.
Kroeger, Brian, et al., "AM digital data service system study report", iBiquity Digital Corporation Rev. 01.14, (Dec. 2010), 1-49.
Mendenhall, et al., "Broadcasting Harnesses the Digital Age", Microwaves & RF, (Dec. 2011), 1-8.
"U.S. Appl. No. 15/277,481, Non Final Office Action dated Feb. 12, 2018", 5 pgs.
"International Application Serial No. PCT/US2017/028812, International Preliminary Report on Patentability dated Nov. 1, 2018", 8 pgs.

* cited by examiner

OVER-THE-AIR RADIO BROADCAST SIGNAL METADATA

RELATED APPLICATION AND PRIORITY CLAIM

This application is a Continuation of U.S. patent application Ser. No. 15/493,605, filed on Apr. 21, 2017 and entitled "OVER-THE-AIR RADIO BROADCAST SIGNAL METADATA", which is related and claims priority to U.S. Provisional Application No. 62/326,432, filed on Apr. 22, 2016 and entitled "SYSTEMS AND METHODS FOR PROVIDING META DATA ASSOCIATED WITH OVER-THE-AIR RADIO BROADCAST SIGNALS," the entirety of which is incorporated herein by reference.

TECHNICAL FIELD

The technology described in this patent document relates to systems and methods for providing supplemental data (e.g., metadata) that is associated with over-the-air radio broadcast signals.

BACKGROUND

Over-the-air radio broadcast signals are commonly used to deliver a variety of programming content (e.g., audio, etc.) to radio receiver systems. Such over-the-air radio broadcast signals include conventional AM and FM analog broadcast signals, digital radio broadcast signals, or other broadcast signals. Digital radio broadcasting technology delivers digital audio and data services to mobile, portable, and fixed receivers. One type of digital radio broadcasting, referred to as in-band on-channel (IBOC) digital audio broadcasting (DAB), uses terrestrial transmitters in the existing Medium Frequency (MF) and Very High Frequency (VHF) radio bands. HD Radio™ technology, developed by iBiquity Digital Corporation, is one example of an IBOC implementation for digital radio broadcasting and reception. An IBOC implementation of digital radio broadcasting and reception is described in U.S. Pat. No. 8,676,114, which is incorporated herein by reference in its entirety.

DESCRIPTION OF EMBODIMENTS

Figure 1:
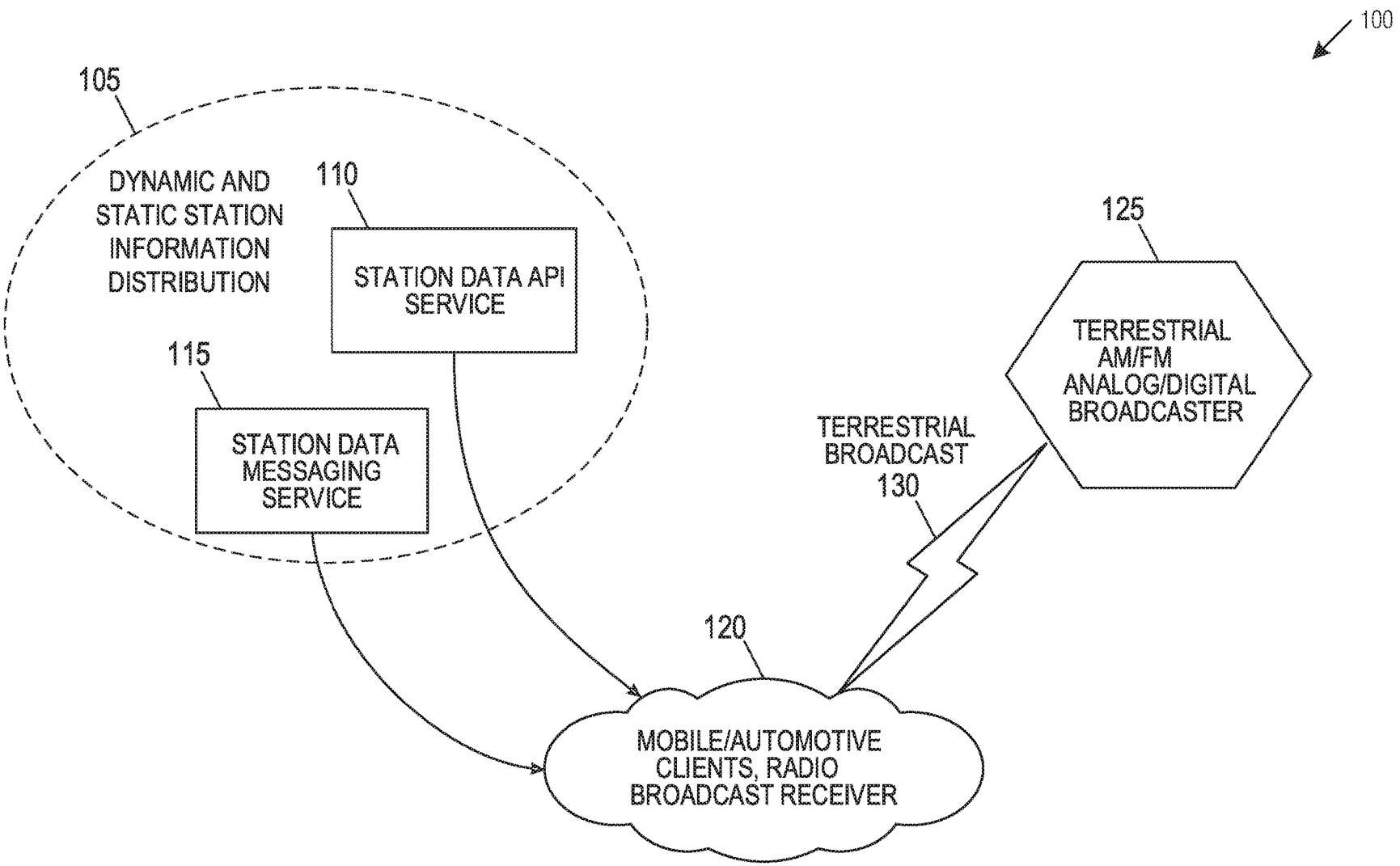
FIG. 1 is a block diagram depicting an example system for providing metadata associated with over-the-air radio broadcast signals.

Over-the-air radio broadcast signals are commonly used to deliver a variety of programming content (e.g., audio, etc.) to radio receiver systems. Supplemental data (e.g., metadata) may be provided to radio broadcast receiver systems, where such supplemental data is associated with the programming content delivered via the over-the-air radio broadcast signals. In exemplary embodiments described herein, a radio receiver system receives both (i) primary programming content (e.g., audio, etc.) via over-the-air radio broadcast transmission, and (ii) metadata related to the programming content via wireless Internet. Such embodiments may thus utilize two different communication platforms, with the different communication platforms enabling the radio receiver system to receive relevant metadata in concert with terrestrial radio broadcast signals. Such a system can be described as a "hybrid radio" system.

The metadata related to the programming content can include both "static" metadata and "dynamic" metadata. For example, when the radio receiver system is receiving an over-the-air radio broadcast signal from a particular radio station, the receiver system may receive static metadata via wireless IP, where the static metadata changes infrequently or does not change. The static metadata may include the radio station's call sign, name, logo (e.g., higher or lower logo resolutions), slogan, station format, station genre, language, web page URL, URL for social media (e.g., Facebook, Twitter), phone number, SMS number, SMS short code, PI code, country, or other information. As another example, when the radio receiver system is receiving an over-the-air broadcast signal including audio, the receiver system may receive dynamic metadata via wireless IP, where the dynamic metadata changes relatively frequently. The dynamic metadata may include a song name, artist name, album name, artist image (e.g., higher or lower resolutions), enhanced advertising (e.g., title, tag line, image, phone number, SMS number, URL, search terms), program schedules (image, timeframe, title, artist name, DJ name, phone number, URL), service following data, or other information related to the audio.

In various embodiments, the systems and methods described herein provide a user with an enhanced experience (e.g., an enhanced listening experience) regardless of the type of terrestrial broadcast signal that is received at the user's radio receiver system. For example, conventionally, a user receiving a conventional analog AM or FM radio broadcast signal is provided little, if any, metadata in addition to the received audio (e.g., a user's automotive receiver may display only a song title and artist name). By contrast, embodiments of the systems and methods described herein enable an enhanced user experience by providing a variety of different metadata in concert with the primary programming content. Thus, for example, users receiving radio broadcast signals at a receiver system may view images, videos, multimedia displays, text, etc., that is related to the programming content received via the over-the-air radio broadcast signals. As described herein, in embodiments, such metadata is provided via wireless IP and not via radio broadcast transmission.

The following description and the drawings sufficiently illustrate specific embodiments to enable those skilled in the art to understand the specific embodiment. Other embodiments may incorporate structural, logical, electrical, process, and other changes. Portions and features of various embodiments may be included in, or substituted for, those of other embodiments. Embodiments set forth in the claims encompass all available equivalents of those claims.

FIG. 1 is a block diagram depicting an example system 100 for providing metadata associated with over-the-air radio broadcast signals. In this figure, a radio broadcast receiver system 120 receives signals and/or data via multiple (e.g., two) different communication platforms. A first communication platform may be an over-the-air radio broadcast transmission (e.g., an analog radio broadcast transmission and/or a digital radio broadcast transmission), and a second communication medium may be wireless Internet (also referred to herein as "wireless IP"). In embodiments, primary programming content (e.g., audio that is rendered at the user's radio receiver system) is delivered to the receiver system 120 via the over-the-air radio broadcast transmission, and metadata related to the programming content is delivered to the receiver system 120 via wireless IP.

In FIG. 1, to facilitate the providing of the programming content via the first communication platform, a radio broadcast transmitter system 125 includes components that can be used to broadcast an over-the-air, radio broadcast signal 130 to the radio broadcast receiver system 120. The transmitter system 125 may broadcast conventional AM and FM analog broadcast signals and/or digital radio broadcast signals. The over-the-air radio broadcast signal 130 including audio and/or data may be broadcasted from an antenna of the transmitter system 125 and received by the radio broadcast receiver system 120, as shown in the figure.

As explained above, the second communication platform used in delivering the metadata to the receiver system 120 may be wireless Internet (e.g., Wi-Fi, mobile telecommunications technologies such as 3G, 4G, etc.). In FIG. 1, the radio receiver system 120 receives metadata from a dynamic and static information distribution service 105, which may include a station data API service 110 and station data messaging service 115. These services are described in greater detail below with reference to FIGS. 4-7. In examples, the receiver system 120 transmits requests (e.g., requests for metadata) to one or both of these services. In response to these requests, the receiver system 120 receives requested data via wireless Internet. In embodiments, the metadata received by the receiver system 120 via the wireless Internet is related to the programming content received via the terrestrial broadcast signal 130. The metadata can include both "static" metadata and "dynamic" metadata. For example, when the radio receiver system 120 is receiving the over-the-air radio broadcast signal 130 from a particular radio station, the receiver system 120 may receive via wireless IP static metadata that indicates the radio station's call sign, name, logo, and/or other information. As another example, when the radio receiver system 120 is receiving the over-the-air broadcast signal 130 including audio, the receiver system 120 may receive via wireless IP dynamic metadata that indicates a song name, artist name, album name, and/or other information related to the audio. Content relating to such metadata, such as artist imagery, album cover imagery, song title, etc., can be displayed on a display of the receiver system 120, e.g., an information/entertainment system such as in a vehicle.

Radio broadcast signal 130 may be subject to intermittent fades or blockages that may result in problems with signal quality for signals received at the receiver system 120. Further, some such blockages may sufficiently obscure the broadcast signal 130 from the receiver system 120 for periods of time such that the blockages produce a gap in the reception of the broadcast signal 130 and thus gaps in the program content, e.g., a song, traffic report or weather report, that the user/consumer desires to hear. In embodiments, to mitigate the effects of such signal disruptions and/or gaps, the receiver system 120 may receive "gap-filling" data via the wireless Internet, as described in U.S. patent application Ser. No. 14/580,920, which is incorporated herein by reference in its entirety so that the program content (e.g., song, traffic, weather content) that would otherwise be obscured or blocked in the terrestrial broadcast may nevertheless be received at the receiver system 120 via wireless internet and rendered for user or consumer consumption. The metadata described herein is data that is provided in addition to any such gap-filling data conveying program content.

Specifically, the gap-filling data comprises primary programming content (e.g., portions of the programming content that is received via the terrestrial signal 130), while the metadata described herein is supplemental data that is related to but different from the primary programming content.

Unlike the gap-filling data, metadata such as described herein is not duplicate data of data transmitted via over-the-air radio broadcast signals.

The radio receiver system 120 used to receive the over-the-air radio broadcast signals and the metadata via the wireless IP may be, for example, a hand-held device (e.g., a tablet, mobile phone, etc.) that includes hardware and/or software for implementing both an Internet receiver for receiving metadata via wireless IP and a radio receiver (e.g., a wireless 3G or 4G chipset and HD Radio chipset and associated antenna systems). In another example, the receiver system may comprise (i) an automotive receiver (e.g., a receiver included in an automobile) that includes a radio receiver, and (ii) a mobile phone that includes the Internet receiver. In this example, the automotive receiver and the mobile phone may be connected via a physical link (e.g., a cable, etc.) or a wireless link (e.g., Bluetooth, etc.) and may work together to implement receiver-side processes (e.g., displaying metadata in concert with the received radio broadcast signal). For example, the radio (e.g., automotive) receiver may include any suitable combination of hardware, software and/or firmware, to communicate (e.g., wirelessly) the currently tuned frequency and information regarding the current broadcast coverage area to a mobile phone or tablet having a computer processor, which runs an application that processes that tuned frequency, location information, and any other suitable information to access metadata from a server and then display or otherwise render information associated with the metadata at the mobile phone or tablet. In yet another example, the receiver system may comprise an automotive receiver or a home receiver that includes a wireless 3G or 4G chipset and a radio baseband processor such as an HD Radio chipset and associated antenna systems and includes a display, computer processor, and application software and/or firmware to access and display or otherwise render information associated with the metadata. In a still further example, the receiver system on a handheld device such as a mobile phone or smart phone includes a radio receiver in addition to wireless network access such as Wi-Fi, Bluetooth, 3G, or 4G.

Figure 2:
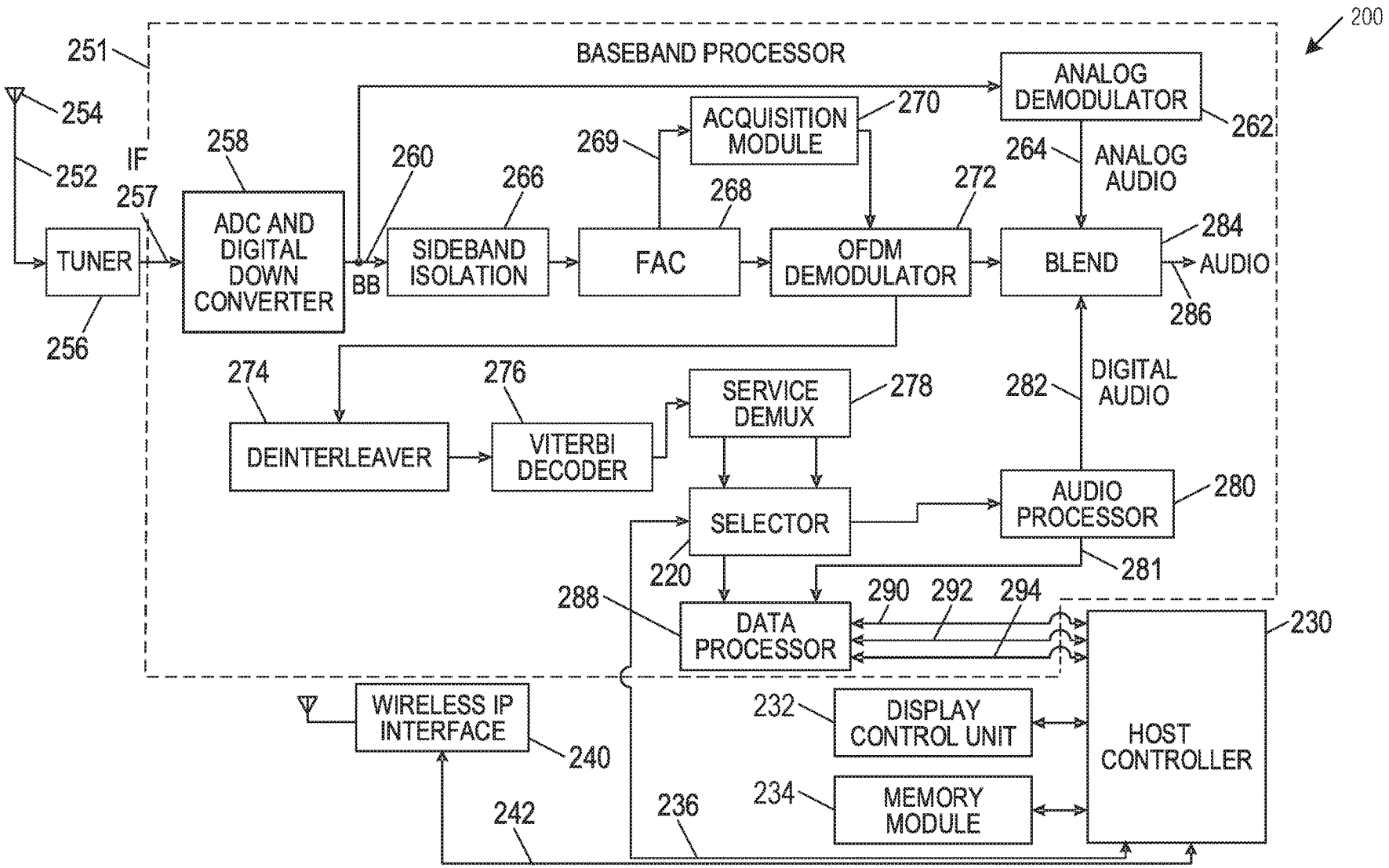
FIG. 2 is a simplified functional block diagram of the relevant components of an example radio broadcasting receiver.

FIG. 2 is a simplified functional block diagram of the relevant components of an example IBOC digital radio broadcasting receiver 200. The IBOC digital radio broadcasting receiver system 200 may be a component of the radio broadcast receiver 120 shown in FIG. 1. To implement the approaches of the instant disclosure, the IBOC digital radio broadcasting receiver 200 includes a wireless IP interface 240 for receiving metadata via wireless IP and other components for receiving over-the-air radio broadcast signals. The wireless IP interface 240 and host controller 230 may be collectively referred to as a wireless internet protocol hardware communication module.

It should be understood that the receiver 200 of FIG. 2 is merely an example. In other examples, the radio broadcast receiver system 120 shown in FIG. 1 does not use the receiver 200 of FIG. 2 and instead uses other hardware and/or software for implementing both an Internet receiver and a radio receiver.

While only certain components of the receiver 200 are shown for exemplary purposes, it should be apparent that the receiver may comprise a number of additional components. The additional components may be distributed among a number of separate enclosures having tuners and front-ends, speakers, remote controls, various input/output devices, and other components. The exemplary receiver includes a tuner 256 that has an input 252 connected to an antenna 254. The antenna 254, tuner 256, and baseband processor 251 may be collectively referred to as an over-the-air radio broadcast hardware communication module.

Within the baseband processor 251, the intermediate frequency signal 257 from the tuner 256 is provided to an analog-to-digital converter and digital down converter 258 to produce a baseband signal at output 260 comprising a series of complex signal samples. The signal samples are complex in that each sample comprises a "real" component and an "imaginary" component. An analog demodulator 262 demodulates the analog modulated portion of the baseband signal to produce an analog audio signal on line 264. The digitally modulated portion of the sampled baseband signal is next filtered by isolation filter 266, which has a pass-band frequency response comprising the collective set of subcarriers $f_1$-$f_n$ present in the received OFDM signal. First adjacent canceller (FAC) 268 suppresses the effects of a first-adjacent interferer. Complex signal 269 is routed to the input of acquisition module 270, which acquires or recovers OFDM symbol timing offset/error and carrier frequency offset/error from the received OFDM symbols as represented in received complex signal 269. Acquisition module 270 develops a symbol timing offset $\Delta t$ and carrier frequency offset $\Delta f$, as well as status and control information. The signal is then demodulated (block 272) to demodulate the digitally modulated portion of the baseband signal.

Then the digital signal is de-interleaved by a de-interleaver 274, and decoded by a Viterbi decoder 276. A service de-multiplexer 278 separates main and supplemental program signals from data signals.

The example IBOC digital radio broadcasting receiver 200 of FIG. 2 also includes a wireless IP interface 240 for receiving data via wireless Internet. The wireless IP interface 240 is managed by the host controller 230. As illustrated in FIG. 2, the wireless IP interface 240 and the host controller 230 are coupled via a line 242, and data transmitted between the wireless IP interface 240 and the host controller 230 is sent over this line 242. A component may selects data received via the wireless IP interface 240 for rendering. For example, selector 220 may connect to host controller 230 via line 236 to select specific data received from the wireless IP interface 240.

The data for rendering may include metadata (e.g., text, images, video, etc.), as described herein, and may be rendered at substantially the same time that primary programming content received over-the-air (e.g., audio received via an over-the-air radio broadcast signal) is rendered.

In some examples, a component (e.g., the selector 220) of the receiver 200 may make a request to a file server for metadata, e.g., via the wireless IP interface 240, which communicates with the host controller 230, to send a request for the metadata. An audio processor 280 processes received signals to produce an audio signal on line 282 and MPSD/SPSD 281. In embodiments, analog and main digital audio signals are blended as shown in block 284, or the supplemental program signal is passed through, to produce an audio output on line 286. A data processor 288 processes received data signals and produces data output signals on lines 290, 292, and 294. The data lines 290, 292, and 294 may be multiplexed together onto a suitable bus such as an $I^2c$, SPI, UART, or USB. The data signals can include, for example, data representing the metadata to be rendered at the receiver.

The host controller 230 receives and processes the data signals. The host controller 230 comprises a microcontroller that is coupled to the DCU 232 and memory module 234. Any suitable microcontroller could be used such as an 8-bit RISC microcontroller, an advanced RISC machine 32-bit microcontroller, or any other suitable microcontroller. Additionally, a portion or all of the functions of the host controller 230 could be performed in a baseband processor (e.g., the processor 280 and/or data processor 288). The DCU 232 comprises any suitable input/output (I/O) processor that controls the display, which may be any suitable visual display such as an LCD or LED display. In certain embodiments, the DCL 232 may also control user input components via a touch-screen display. In certain embodiments, the host controller 230 may also control user input from a keyboard, dials, knobs or other suitable inputs. The memory module 234 may include any suitable data storage medium such as RAM, Flash ROM (e.g., an SD memory card), and/or a hard disk drive. In certain embodiments, the memory module 234 may be included in an external component that communicates with the host controller 230 such as a remote control.

Figure 3:
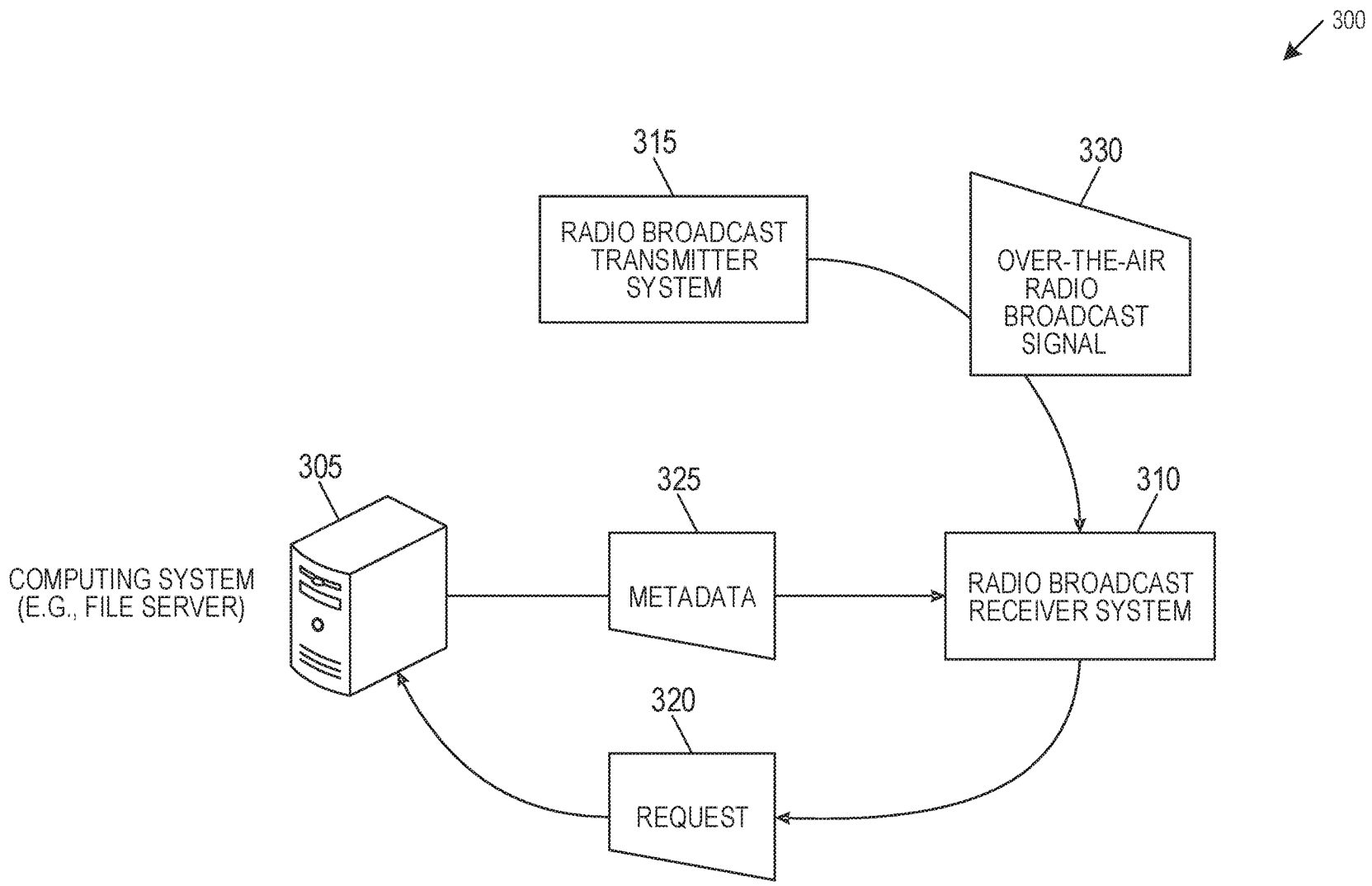
FIG. 3 illustrates additional details of the approaches of the instant disclosure.

FIG. 3 illustrates additional details 300 of the approaches of the instant disclosure, in accordance with some embodiments. In FIG. 3, a radio broadcast receiver system 310 tunes into a station, where the station is associated with a radio broadcast transmitter system 315. Based on the tuning into the station, the receiver system 310 may begin to receive an over-the-air radio broadcast signal 330 from the transmitter system 315. The receiver system 310 may generate a download request 320 that is transmitted to a computing system 305. As described in further detail below, in embodiments, the download request 320 is transmitted to the computing system 305 via an APL. The download request 320 may request from the computing system 305 various metadata 325 associated with the station to which the receiver system 310 is tuned. Further, the download request 320 may request from the computing system 305 various metadata 325 associated with the particular programming content included in the broadcast signal 330.

Based on the download request 320, metadata 325 (e.g., in the form of computer files, etc.) may be downloaded wirelessly from the computing system 305 to the receiver system 310 using an Internet protocol, such as HyperText Transfer Protocol (HTTP), HyperText Transfer Protocol Secure (HTTPS), File Transfer Protocol (FTP) or File Transfer Protocol Secure (FTPS).

In an embodiment, the receiver system 310 may include a mobile phone, and the mobile phone may execute a mobile software application program (e.g., a mobile app). The transmitting of the download request and the receiving of the metadata 325 may be performed based on user input received via the mobile software application program. In other embodiments, the receiver system 310 may include an automotive receiver system executing a software application. The transmitting of the download request and the receiving of the metadata 325 may be performed based on user input received via the software application. In other embodiments, the downloading of the metadata 325 is performed automatically and not in response to user input. In examples, data from a messaging service triggers the requesting of metadata 325 by the receiver system. Such a messaging system is described below with reference to FIGS. 4 and 5.

Figure 4:
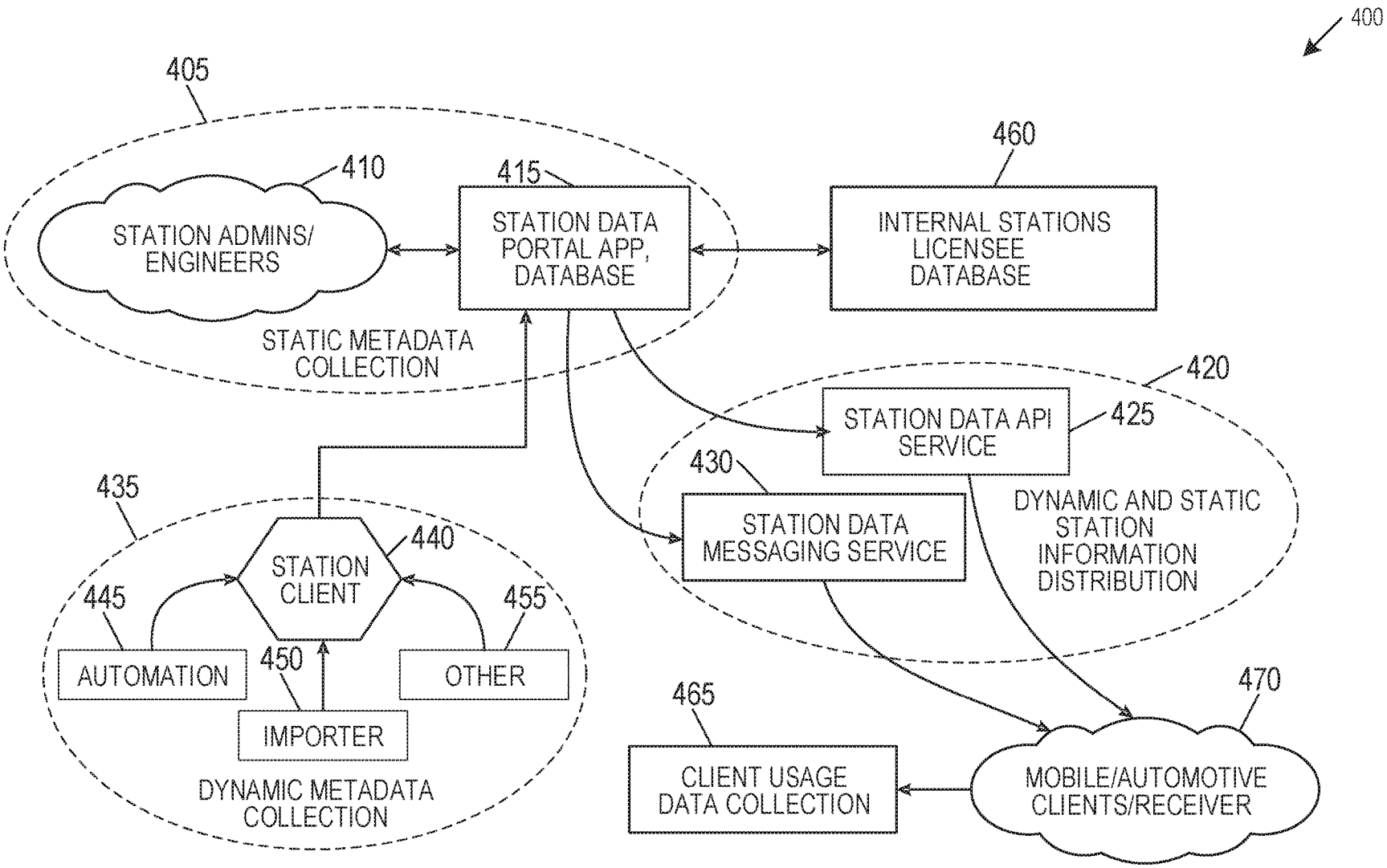
FIG. 4 is a diagram showing example components of a core hybrid radio system.

FIG. 4 is a diagram showing example components of a core hybrid radio system 400. The Static Metadata Collection service 405 includes a portal that allows broadcasters, station administrators, or engineers 410 to input various information about their station (e.g., logo, slogan, etc.) into a station data portal application or database 415. Such information may comprise "static metadata," as described herein. This service 405 also interacts with internal Station databases 460 to gather other static station data.

Further, the service 405 keeps track of what is being played by multiple different radio stations by interfacing with the Dynamic Metadata Collection service 435. The information regarding the songs that are being played by the radio stations comprises "dynamic metadata," as described herein. Each radio station runs an instance of the Dynamic Metadata Collection service 435 and interfaces the service 435 to the station's playout system. The service 435 collects station events such as current and past song data, and reports this information to the Static Metadata Collection service 405. Dynamic Metadata Collection service 435 may collect metadata at a station client 440 from automated collection services 445 (e.g., from internet radio streams, radio DNS, radio station information databases), from an importer 450, or from other metadata sources 455.

Radio broadcast receiver 470 access the core hybrid radio system through an API and messaging service shown at reference numeral 420 in FIG. 4. Radio broadcast receiver 470 register with the system and when new events require the radio broadcast receiver 470 to gather new metadata, the messaging system 430 notifies the radio broadcast receiver 470 regarding these events. For example, when a new song is being broadcasted by a radio station, the messaging system 430 may notify the radio broadcast receiver 470 that a previous song is no longer being broadcasted and that the new song is now being broadcasted. The radio broadcast receiver 470 gathers metadata by accessing the Station Data API service 425. Thus, for example, in response to receiving the notification that the new song is being played, the radio broadcast receiver 470 may access the Station Data API service 425 to request information (e.g., song name, artist, album name, etc.) for the new song. Such information comprises metadata for the new song.

The radio broadcast receiver 470 reports various data regarding user interaction and field information through the client usage data collection module 465. The module 465 thus collects various metrics and usage data from the receiver 470, (e.g., what stations users are listening to, when the users are listening to such stations, and other metrics) regarding user listening.

Figure 5:
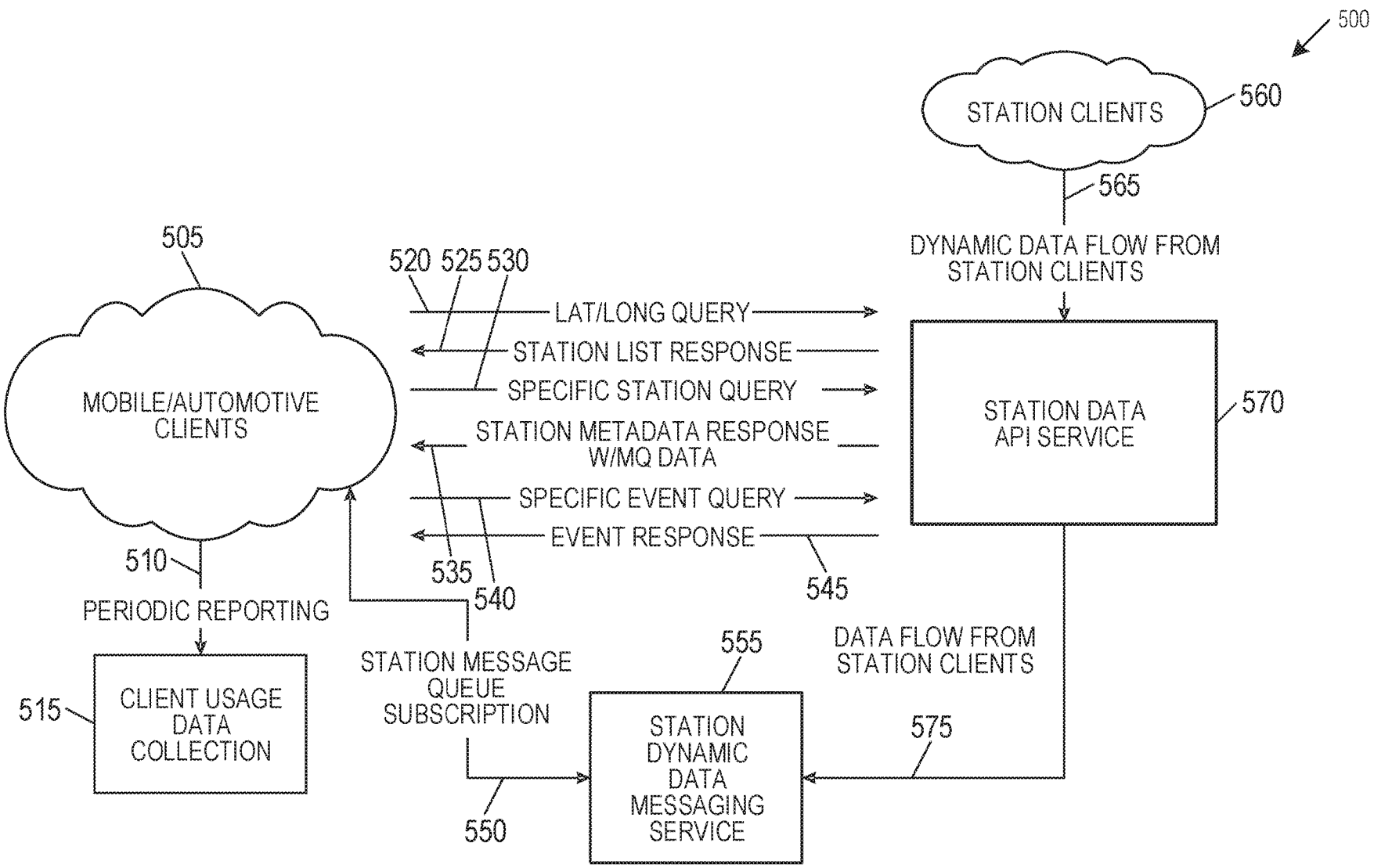
FIG. 5 is a diagram showing example interactions between client applications and the API and messaging services.

FIG. 5 is a diagram 500 showing example metadata interactions. In particular, diagram 500 shows the metadata interactions between the radio broadcast receiver client 505 and the station data API service 570. The messaging service 555 may receive station message queue subscription information 550 from the client 505. Station data API service 570 may receive dynamic data flow 565 from station clients 560, which may be shared with the messaging service 555. The mobile client 505 may also provide periodic reporting 510 to a client usage data collection 515 for subsequent analysis.

In an embodiment, radio broadcast receiver client 505 may initiate interaction by providing the API the latitude and longitude of their location 520. The API calculates which stations are listenable from that location and responds with a list of listenable stations 525. The radio broadcast receiver client 505 may then request full data about individual stations via a specific station query 535 and receive a response 535, or may request full data about individual stations via an event query 540 and receive a response 545. The radio broadcast receiver client 505 can subscribe to the messaging queue to be notified when updated data becomes available so that the client can retrieve current data. While this specifies a latitude/longitude query for location information, other queries by city, state, ZIP code, or other means of geographic identification may also be possible.

This disclosure has been described in detail and with reference to exemplary embodiments thereof, it will be apparent to one skilled in the art that various changes and modifications can be made therein without departing from the spirit and scope of the embodiments. Thus, it is intended that the present disclosure cover the modifications and variations of this disclosure provided they come within the scope of the appended claims and their equivalents.

To better illustrate the method and apparatuses disclosed herein, a non-limiting list of embodiments is provided here.

Example 1 is a broadcast radio receiver system comprising: an over-the-air radio broadcast hardware communication module to receive an over-the-air radio broadcast signal, the over-the-air radio broadcast signal including a primary programming audio content; a wireless internet protocol hardware communication module to receive a wireless internet protocol signal, the wireless internet protocol signal including metadata associated with the over-the-air radio broadcast signal; a broadcast radio receiver display; and a processor to cause the broadcast radio receiver display to display at least a portion of the metadata.

In Example 2, the subject matter of Example 1 optionally includes the processor further to select a portion of the metadata associated with the primary programming audio content, wherein displaying the portion of the metadata includes displaying the selected portion of the metadata on the broadcast radio receiver display.

In Example 3, the subject matter of any one or more of Examples 1-2 optionally include an audio system, the processor further to cause a primary programming audio content to be played through the audio system, wherein the over-the-air radio broadcast signal includes the primary programming audio content.

In Example 4, the subject matter of Example 3 optionally includes the processor further to: detect a disruption of the over-the-air radio broadcast signal; and cause a copy of the primary programming audio content to be played through the audio system responsive to detecting the disruption, wherein the wireless internet protocol signal includes the copy of the primary programming audio content.

In Example 5, the subject matter of any one or more of Examples 1-4 optionally include the processor further to cause the wireless internet protocol hardware communication module to transmit a metadata request to a station data service, wherein receiving the wireless internet protocol signal is responsive to transmitting the metadata request.

In Example 6, the subject matter of Example 5 optionally includes wherein the station data service includes at least one of a station data API service and a station data messaging service.

In Example 7, the subject matter of any one or more of Examples 1-6 optionally include wherein the metadata includes a set of static metadata.

In Example 8, the subject matter of Example 7 optionally includes wherein the set of static metadata includes at least one of a radio station call sign, a radio station name, and a radio station logo.

In Example 9, the subject matter of any one or more of Examples 1-8 optionally include wherein the metadata includes a set of dynamic metadata.

In Example 10, the subject matter of Example 9 optionally includes wherein the set of dynamic metadata includes at least one of a song name, an artist name, and an album name.

In Example 11, the subject matter of any one or more of Examples 1-10 optionally include wherein the over-the-air radio broadcast signal includes at least one of an analog radio broadcast transmission and a digital radio broadcast transmission.

Example 12 is a method for providing metadata associated with over-the-air radio broadcast signals to a broadcast radio receiver system, the method comprising: receiving an over-the-air radio broadcast signal at a radio broadcast receiver, the over-the-air radio broadcast signal including a primary programming audio content; receiving a wireless internet protocol signal at the radio broadcast receiver, the wireless internet protocol signal including metadata associated with the over-the-air radio broadcast signal; and displaying at least a portion of the metadata.

In Example 13, the subject matter of Example 12 optionally includes wherein: the radio broadcast receiver includes a radio display; and displaying the portion of the metadata includes displaying the portion of the metadata on the radio display.

In Example 14, the subject matter of Example 13 optionally includes selecting a portion of the metadata associated with the primary programming audio content, wherein displaying the portion of the metadata includes displaying the selected portion of the metadata on the radio display.

In Example 15, the subject matter of any one or more of Examples 12-14 optionally include playing a primary programming audio content through the radio broadcast receiver, wherein the over-the-air radio broadcast signal includes the primary programming audio content.

In Example 16, the subject matter of any one or more of Examples 12-15 optionally include detecting a disruption of the over-the-air radio broadcast signal; and playing a copy of the primary programming audio content through the radio broadcast receiver responsive to detecting the disruption, wherein the wireless internet protocol signal includes the copy of the primary programming audio content.

In Example 17, the subject matter of any one or more of Examples 12-16 optionally include transmitting a metadata request from the radio broadcast receiver to a station data service, wherein receiving the wireless internet protocol signal is responsive to transmitting the metadata request.

In Example 18, the subject matter of Example 17 optionally includes wherein the station data service includes at least one of a station data API service and a station data messaging service.

In Example 19, the subject matter of any one or more of Examples 12-18 optionally include wherein the metadata includes a set of static metadata.

In Example 20, the subject matter of Example 19 optionally includes wherein the set of static metadata includes at least one of a radio station call sign, a radio station name, and a radio station logo.

In Example 21, the subject matter of any one or more of Examples 12-20 optionally include wherein the metadata includes a set of dynamic metadata.

In Example 22, the subject matter of Example 21 optionally includes wherein the set of dynamic metadata includes at least one of a song name, an artist name, and an album name.

In Example 23, the subject matter of any one or more of Examples 12-22 optionally include wherein the over-the-air radio broadcast signal includes at least one of an analog radio broadcast transmission and a digital radio broadcast transmission.

Example 24 is at least one machine-readable medium including instructions, which when executed by a computing system, cause the computing system to perform any of the methods of Examples 12-23.

Example 25 is an apparatus comprising means for performing any of the methods of Examples 12-23.

The above detailed description includes references to the accompanying drawings, which form a part of the detailed description. The drawings show specific embodiments by way of illustration. These embodiments are also referred to herein as "examples." Such examples can include elements in addition to those shown or described. Moreover, the subject matter may include any combination or permutation of those elements shown or described (or one or more aspects thereof), either with respect to a particular example (or one or more aspects thereof), or with respect to other examples (or one or more aspects thereof) shown or described herein.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to allow the reader to quickly ascertain the nature of the technical disclosure. It is submitted with the understanding that it will not be used to interpret or limit the scope or meaning of the claims, in the above Detailed Description, various features may be grouped together to streamline the disclosure. This should not be interpreted as intending that an unclaimed disclosed feature is essential to any claim. Rather, the subject matter may lie in less than all features of a particular disclosed embodiment. Thus, the following claims are hereby incorporated into the Detailed Description, with each claim standing on its own as a separate embodiment, and it is contemplated that such embodiments can be combined with each other in various combinations or permutations. The scope should be determined with reference to the appended claims, along with the full scope of equivalents to which such claims are entitled.

What is claimed is:

1. A broadcast radio receiver system comprising:

an over-the-air radio broadcast hardware communication module to receive a terrestrial over-the-air radio broadcast signal via a radio broadcast transmission transmitted over a radio broadcast channel, the terrestrial over-the-air radio broadcast signal including a primary programming audio content;

a wireless internet protocol hardware communication module to receive a wireless internet protocol signal via a wireless internet communication medium transmitted over an internet protocol channel, the wireless internet protocol signal including metadata associated with the primary programming audio content of the terrestrial over-the-air radio broadcast signal, the metadata including information describing the primary programming audio content;

a broadcast radio receiver display; and a processor to: cause the broadcast radio receiver display to display at least a portion of the metadata based on the received terrestrial over-the-air radio broadcast signal; detect a disruption of the terrestrial over-the-air radio broadcast signal; and cause a copy of the primary programming audio content to be played through the audio system responsive to detecting the disruption, wherein the wireless internet protocol signal includes the copy of the primary programming audio content.

2. The broadcast radio receiver system of claim 1, the processor further to select a portion of the metadata associated with the primary programming audio content, wherein displaying the portion of the metadata includes displaying the selected portion of the metadata on the broadcast radio receiver display.

3. The broadcast radio receiver system of claim 1, further including an audio system, the processor further to cause the primary programming audio content to be played through the audio system, wherein the terrestrial over-the-air radio broadcast signal includes the primary programming audio content.

4. The broadcast radio receiver system of claim 1, wherein the metadata includes a set of static metadata.

5. The broadcast radio receiver system of claim 4, wherein the set of static metadata includes at least one of a radio station call sign, a radio station name, and a radio station logo.

6. The broadcast radio receiver system of claim 1, wherein the metadata includes a set of dynamic metadata.

7. The broadcast radio receiver system of claim 6, wherein the set of dynamic metadata includes at least one of a song name, an artist name, and an album name.

8. A method for providing metadata associated with terrestrial over-the-air radio broadcast signals to a broadcast radio receiver system, the method comprising:

receiving a terrestrial over-the-air radio broadcast signal at a radio broadcast receiver via a radio broadcast transmission transmitted over a radio broadcast channel, the terrestrial over-the-air radio broadcast signal including a primary programming audio content, the metadata including information describing the primary programming audio content transmitting a metadata request to a station data device; the metadata request including identification of the radio broadcast channel; and;

receiving a wireless internet protocol signal at the radio broadcast receiver via a wireless internet communication medium transmitted over an internet protocol channel responsive to the metadata request, the wireless internet protocol signal including metadata associated with the primary programming audio content of the terrestrial over-the-air radio broadcast signal; and displaying at least a portion of the metadata based on the received terrestrial over-the-air radio broadcast signal.

9. The method of claim 8, wherein:

the radio broadcast receiver includes a radio display; and displaying the portion of the metadata includes displaying the portion of the metadata on the radio display.

10. The method of claim 9, further including selecting a portion of the metadata associated with the primary programming audio content, wherein displaying the portion of the metadata includes displaying the selected portion of the metadata on the radio display.

11. The method of claim 8, further including playing a primary programming audio content through the radio broadcast receiver, wherein the terrestrial over-the-air radio broadcast signal includes the primary programming audio content.

12. The method of claim 8, wherein the station data includes at least one of a station data API service and a station data messaging service.

13. The method of claim 8, wherein the metadata includes a set of static metadata.

14. The method of claim 13, wherein the set of static metadata includes at least one of a radio station call sign, a radio station name, and a radio station logo.

15. The method of claim 8, wherein the metadata includes a set of dynamic metadata.

16. The method of claim 15, wherein the set of dynamic metadata includes at least one of a song name, an artist name, and an album name.

17. A method for providing metadata associated with terrestrial over-the-air radio broadcast signals to a broadcast radio receiver system, the method comprising: receiving a terrestrial over-the-air radio broadcast signal at a radio broadcast receiver via a radio broadcast transmission transmitted over a radio broadcast channel, the terrestrial over-the-air radio broadcast signal including a primary programming audio content, the metadata including information describing the primary programming audio content; receiving a wireless internet protocol signal at the radio broadcast receiver via a wireless internet communication medium transmitted over an Internet protocol channel, the wireless internet protocol signal including metadata associated with the primary programming audio content of the terrestrial over-the-air radio broadcast signal; and displaying at least a portion of the metadata based on the received terrestrial over-the-air radio broadcast signal; detecting a disruption of the terrestrial over-the-air radio broadcast signal; and playing the digital streaming audio copy of the primary programming audio content through the radio broadcast receiver responsive to detecting the disruption, wherein the wireless internet protocol signal includes the digital streaming audio copy of the primary programming audio content.

18. The method of claim 17, further including selecting a portion of the metadata associated with the primary programming audio content, wherein: the radio broadcast receiver includes a radio display; displaying the portion of the metadata includes displaying the portion of the metadata on the radio display.

19. The method of claim 17, further including playing a primary programming audio content through the radio broadcast receiver, wherein the terrestrial over-the-air radio broadcast signal includes the primary programming audio content.

20. The method of claim 17, further including transmitting a metadata request from the radio broadcast receiver to a station data service, the metadata request including an identification of the radio broadcast channel, wherein receiving the wireless internet protocol signal is responsive to transmitting the metadata request.

* * * * *